US005970555A

United States Patent [19]

Baek et al.

[11] Patent Number: 5,970,555

[45] Date of Patent: Oct. 26, 1999

[54] METHOD AND CONTROL APPARATUS OF DETECTING ECCENTRICITY IN DRUM WASHING MACHINE

[75] Inventors: Seung Myun Baek; Seung Taek Baek; Jeong Hyun Lim, all of Kyungsangnam-do, Rep. of Korea

[73] Assignee: LG Electronics Inc., Seoul, Rep. of Korea

[21] Appl. No.: 09/080,926

[22] Filed: May 19, 1998

[30] Foreign Application Priority Data

May 20, 1997 [KR] Rep. of Korea ..... 97-19577
Mar. 10, 1998 [KR] Rep. of Korea ..... 98-7956

[51] Int. Cl.[6] ..... D06F 37/30

[52] U.S. Cl. ..... 8/159; 68/12.04; 68/12.06

[58] Field of Search ..... 8/142, 140, 159; 68/12.02, 12.04, 12.05, 12.21, 18 C, 18 R, 23.02, 23.04, 23.03

[56] References Cited

U.S. PATENT DOCUMENTS 3,152,462 10/1964 Elliott et al. ..... 68/12.02
3,226,016 12/1965 Couper et al. ..... 68/23.3
3,430,852 3/1969 Lenkey et al. .
3,674,419 7/1972 Tichy .
4,096,988 6/1978 Scuricini .
4,433,592 2/1984 Tatsumi et al. .
4,522,620 6/1985 Leister .
4,910,502 3/1990 Serveau et al. .
5,070,565 12/1991 Sood et al. .
5,375,282 12/1994 Dausch et al. .

FOREIGN PATENT DOCUMENTS 61-40856 9/1986 Japan ..... 68/23.3
2-249595 10/1990 Japan ..... 68/12.04

*Primary Examiner*—Frankie L. Stinson
*Attorney, Agent, or Firm*—Fleshner & Kim

[57] ABSTRACT

A device and method for controlling a washing machine detects an amount of eccentricity of a tub of the washing machine and determines whether the degree of eccentricity is acceptable. The degree of eccentricity is measured by causing the tub to rotate at a substantially constant speed, and counting the number of times that the rotational speed of the tub changes during a predetermined period of time. The device and method determine whether a degree of eccentricity is acceptable based a comparison of the determined degree of eccentricity to one or more of a plurality of predetermined eccentricity reference values, and based on a number of times that the determination has been made unsuccessfully. The eccentricity reference values are selected based on a compensated laundry volume level. The compensated laundry volume level, in turn, is based on a detected laundry volume level, and a laundry volume compensation index that represents the number of times that the determined eccentricity value of the tub exceeds a predetermined eccentricity value during a predetermined time period.

20 Claims, 6 Drawing Sheets

METHOD AND CONTROL APPARATUS OF DETECTING ECCENTRICITY IN DRUM WASHING MACHINE

BACKGROUND OF THE INVENTION

1. Field of the Invention

The present invention relates to a drum washing machine. More particularly, it relates to a method and control apparatus of detecting eccentricity in a drum washing machine for detecting eccentricity of a tub, thereby to determine whether or not to perform a dewatering cycle.

2. Discussion of Related Art

As shown in FIG. 1, generally, a tub driving circuit in a washing machine includes a motor 3 actuated by driving power externally supplied thereto for transmitting rotary power to a tub, a speed sensing unit 4 for sensing rotational speed of the motor 3; an arithmetic and control unit 1 for receiving a signal from the speed sensing unit 4, selection signal generated at a key pad (not shown), and signals from various sensors (not shown) and producing various control signals; and a motor driving unit 2 for positively or reversely rotating the motor 3 according to each control signal of the arithmetic and control unit 1.

The following description concerns washing and hydro-extracting operation through the tub driving circuit having such configuration in the washing machine.

In the washing operation, the arithmetic and control unit 1 receives a rotational speed value of the motor 3 sensed by the speed sensing unit 4, a selection signal generated at the key pad (not shown), and signals from the various sensors (not shown) and produces various control signals.

Once the motor driving unit 2 is switched according to the control signal of the arithmetic and control unit 1 and current flowing in forward direction is applied to the motor, the motor 3 is actuated to rotate in the positive direction. The rotary power of the motor 3 is selectively transmitted to a pulsator (not shown) via a clutch (not shown). The pulsator is then interlocked and rotated, thereby to create mechanical, frictional effect between the pulsator and laundry in the tub.

The arithmetic and control unit 1 controls the rotation of the motor 3 continuously for a predetermined period of time to keep the motor 3 rotating at a predetermined control revolutions per minute (RPM) in the positive rotary direction. After the predetermined time elapses, the arithmetic and control unit 1 turns off the motor 3 for a specified time on reduce the speed of the motor 3 and interrupt it.

Once the motor 3 is brought to a standstill, the arithmetic and control unit o produces a control signal to switch the motor driving unit 2, thus applying reverse current to the motor 3. Driving direction of the motor 3 is then changed to the reverse rotary direction. Rotary power by the reverse rotation of the motor 3 is selectively transmitted to the pulsator (not shown) through the clutch (not shown). The pulsator is then interlocked and rotated, thereby to create mechanical, frictional effect between the pulsator and laundry in the tub.

The arithmetic and control unit 1 controls the rotation of the motor 3 continuously for a predetermined time to keep the motor 3 rotating at a predetermined control RPM in the reverse direction. After the predetermined time elapses, the arithmetic and control unit 1 turns off the motor 3 for a specified time to reduce the speed of the motor 3 and interrupt it.

This control over the positive/reverse rotation of the motor 3 by the arithmetic and control unit 1 is repeatedly performed until the termination of an overall laundry process. Alternative repetition of the positive and reverse rotation creates strong mechanical, frictional effect between the pulsator and the laundry in the tub. The laundry is cleaned due to the strong frictional effect.

The hydro-extracting operation is performed as follows.

According to a control signal of the arithmetic and control unit 1, the motor 3 reversely rotates at predetermined RPM (for example, 50 RPM), thereby to disentangle the laundry tangled during the washing operation to some degree. Subsequently, the motor 3 rotates in the positive direction at high speed according to a control signal of the arithmetic and control unit 1 and allows the tub to rotate at the high speed. The dewatering operation is implemented by way of continuously keeping the tub rotating at high speed.

Whether or not to commence the hydro-extracting operation depends on decision on eccentricity of the tub by the arithmetic and control unit 1. This is because, if the tub is eccentric more than a predetermined degree of eccentricity due to the laundry tending to one side, excessive shaking occurs resulting in big noise and breakage in various mechanical devices, such as a rotary shaft of the tub, when the tub rotates.

Accordingly, the driving circuit of the general washing machine has a function of decision on the eccentricity. The process of deciding the eccentricity of the tub will now be described with reference to the diagram shown in FIG. 2.

The arithmetic and control unit 1, based upon the rotary speed of the motor 3 sensed by the speed sensing unit 4, applies a control signal to the motor 3 to make the tub to reversely rotate at "II" RPM. When the tub reversely rotates at the "II" RPM, the laundry which has been twisted during the washing operation is untwisted. This is a laundry untwisting process. Subsequently, the RPM of the tub reaches point "III", the arithmetic and control unit 1 applies a control signal to the motor 3 to increase the rotational speed of the tub to "I" RPM in order to determine whether or not to commence the hydro-extracting operation. The "I" RPM is speed at which the laundry can be attached to the side wall of the tub and rotates along with the tub.

When the tub rotates at the speed of the "I" RPM, the arithmetic and control unit 1 performs constant speed control to maintain the rotational speed of the tub at the "I" RPM. If the arithmetic and control unit 1 applies constant driving voltage to the motor 3 transmitting the rotary power to the tub, the rotational speed of the tub may not be kept at the "I" RPM constantly and may be changeable according to the degree of the eccentricity of the laundry.

After a predetermined time elapses, when the rotational speed of the motor 3 is sensed to be at the point "IV" (the point where variation of the RPM is determined to be almost constant), the arithmetic and control unit 1 senses a current variation of the RPM through the speed sensing unit 4. On the basis of the variation of the RPM at this point, the arithmetic and control unit 1 performs the decision on the eccentricity of the tub, thereby to perform the hydro-extracting operation or laundry untwisting process according to the decision. Afterward, the arithmetic and control unit 1 newly performs the decision on the eccentricity.

Here, adequate time must be given between the points "III" and "IV" because, if the interposed time between the two points "III" and "IV" is not adequate, there may occur an error in the decision on the eccentricity. In the period between the two points "III" and "IV" before the variation of the RPM converges on the predetermined range, the vibration of the RPM is great, so there is possibility of determining that the eccentricity is severe even when the eccentricity of the tub is small.

The process of decision on the eccentricity of the tub is as follows.

As the degree of the eccentricity of the laundry becomes greater, a deviation between the rotational speed of the tub and the "I" RPM gets larger. If the deviation between the rotational speed of the tub and the "I" RPM greatly changes in an instant, a corresponding signal waveform appears as the form of pulses having a peak. In turn, the arithmetic and control unit 1 measures the number of pulses (the number of RPM values) deviating from the "I" RPM for a unit of time and measures the degree of eccentricity of the laundry in the tub based upon the number of the pulses.

After measuring the degree of eccentricity through the above procedure, the arithmetic and control unit 1 compares the measured degree of eccentricity with a predetermined reference degree of the eccentricity. If the measured degree of the eccentricity is less than the reference degree of eccentricity, the arithmetic and control unit 1 performs the hydro-extracting operation. Alternatively, if the measured degree of eccentricity exceeds the reference degree of eccentricity, the arithmetic and control unit 1 controls the RPM of the motor 3 so as to newly perform the laundry untwisting process.

Afterwards, the arithmetic and control unit 1 newly measures the degree of eccentricity according to the procedure illustrated above and performs the hydro-extracting operation or laundry untwisting process according to a measured result. When repeating the measure of the eccentricity, the arithmetic and control unit 1 counts the number of times of the measuring processes. If the measure of the eccentricity is repeatedly performed more than a predetermined number of times, the arithmetic and control unit 1 treats this state as an unbalance error, thereby to terminate all the operation of the washing machine.

In other words, if the measured degree of eccentricty exceeds the predetermined reference degree even though the arithmetic and control unit 1 repeatedly performs the laundry untwisting process to regulate the degree of eccentricity of the laundry in the tub, the arithmetic and control unit 1 determines that this level of the degree of eccentricity of the laundry cannot be regulated by the washing machine itself, thus interrupting all the operation of the washing machine.

However, the eccentricity detecting method in this conventional drum washing machine is to apply constant driving voltage to the motor and measure degree of eccentricity under the stableness of RPM. This conventional eccentricity detecting method in the general drum washing machine requires much time to make the motor be in a stable status. In addition, there may occur a situation where the degree of eccentricity is difficult to be measured according to the volume of the laundry, thus interrupting accurate measure of the degree of eccentricity. Therefore, the eccentricity detecting method of the conventional drum washing machine has a problem in that shaking and noise rapidly occurs when the hydro-extracting operation is commenced.

This is because the eccentricity detecting method of the conventional drum washing machine compares the measured degree of eccentricity with the reference degree of eccentricity without considering the volume of the laundry though the degree of eccentricity is influenced by the laundry volume. When the driving circuit of the washing machine rotates the tub containing much laundry therein at high speed, the laundry is uniformly distributed in the side wall of the tub resulting in a small degree of eccentricity. Alternatively, when rotating the tub containing small amount of laundry therein at high speed, the laundry is gravitated to a portion of the side wall resulting in significant eccentricity. In the eccentricity detecting method of the conventional drum washing machine, the degree of eccentricity is measured without considering the volume of the laundry, so the washing machine has serious possibility of performing wrong operation.

In the conventional eccentricity detecting method, the constant driving voltage is applied to the motor to rotate the tub at the predetermined speed ("I" RPM) and detects the number of pulses (the number of RPM values) deviating from the "I" RPM for the unit time, thereby to measure the degree of eccentricity based upon the detected number. Accordingly, the conventional eccentricity detecting method requires constant speed control for constantly keeping the tub rotating at predetermined speed.

However, according to the conventional art just applying constant driving voltage to the motor 3 for the constant speed control, does not result in the tub being kept at aimed speed, the "I" RPM. The reason is that, although the motor is controlled with the constant driving voltage, actual rotational speed of the tub is not continuously kept at the predetermined speed, "I" RPM and changes irregularly because of the volume of the laundry in the tub and its eccentricity.

After all, the degree of eccentricity measured according to the conventional method cannot be said accurate since it is measured under the state where the rotational speed of the tub is not constant.

SUMMARY OF THE INVENTION

Accordingly, the present invention is directed to a method and control apparatus of detecting eccentricity in a drum washing machine that substantially obviates one or more of the limitations and disadvantages of the related art.

An objective of the present invention is to provide a method of detecting eccentricity in a drum washing machine and a driving circuit of a drum washing machine employing the detecting method, wherein eccentricity of a tub is measured through different eccentricity measuring steps that account for variations of RPM before commencing hydro-extracting operation, thereby to determine whether or not to perform the hydro-extracting operation.

Additional features and advantages of the invention will be set forth in the description which follows, and in part will be apparent from the description, or may be learned by practice of the invention. The objectives and other advantages of the invention will be realized and attained by the structure as illustrated in the written description and claims hereof, as well as the appended drawings.

To achieve these and other advantages, and in accordance with the purpose of the present invention as embodied and broadly described, a method of detecting eccentricity in a drum washing machine according one embodiment includes: degree of eccentricity measuring step of detecting variation of rotational speed of a tub and measuring degree of eccentricity while positively rotating the tub at predetermined speed; and eccentricity decision step of comparing the measured degree of eccentricity with a reference value of eccentricity corresponding to the measured degree of eccentricity among multiple predetermined reference values of eccentricity and determining whether or not to permit eccentricity.

A method of detecting eccentricity in a drum washing machine according to another embodiment includes: degree of eccentricity measuring step of controlling a tub to positively rotate at predetermined speed and detecting variation of rotational speed of the tub so as to measure degree of eccentricity; laundry volume compensation index measuring step of counting cases where the degree of eccentricity measured exceeds a specified value while the number of trials for eccentricity decision(PC) for measuring the degree of eccentricity of the tub is less than a predetermined number of times and setting the counted value as a laundry volume compensation index (W); laundry volume level compensating step of compensating a previously produced laundry volume level for the number of trials for eccentricity decision (PC) and the laundry volume compensation index (W) and producing a compensated laundry volume level; and eccentricity permission decision step of comparing the degree of eccentricity with a reference value of eccentricity corresponding to the compensated laundry volume level among multiple predetermined reference values of eccentricity, thereby to determine whether or not to permit the eccentricity.

In another aspect, the present invention provides a driving circuit of a drum washing machine including: an arithmetic and control unit for controlling drive of a motor; a motor driving unit for driving the motor according to control of the arithmetic and control unit; a speed sensing unit for sensing rotational speed of the motor and applying a sensed value to the arithmetic and control unit; a motor speed compensating unit for receiving a value of the rotational speed of the motor sensed by the speed sensing unit, detecting a difference between phase angles of driving voltages each applied to the motor from the motor driving unit at a current time point and previous time point, and applying the detected difference to the arithmetic and control unit.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF PREFERRED EMBODIMENT

Reference will now be made in detail to the preferred embodiments of the present invention, examples of which are illustrated in the accompanying drawings.

The present invention will now be described with reference to the accompanying drawings.

Figure 1:
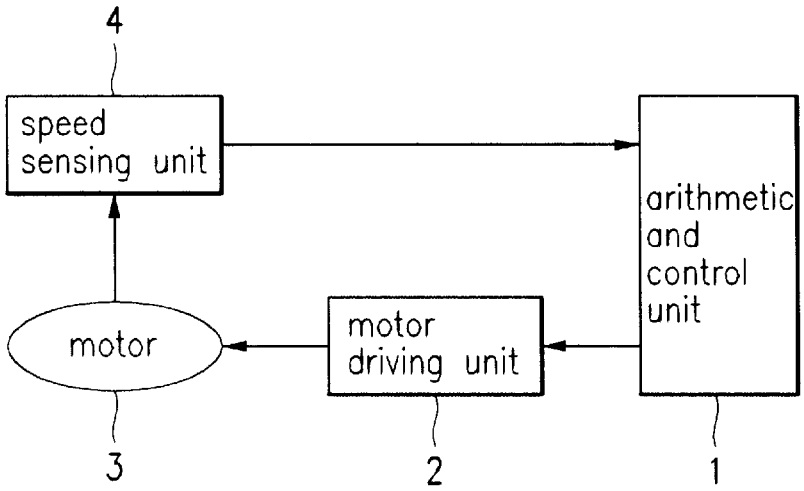
FIG.1 prior art
FIG. 1 is a block diagram of a tub driving circuit in a conventional drum washing machine.
Figure 2:
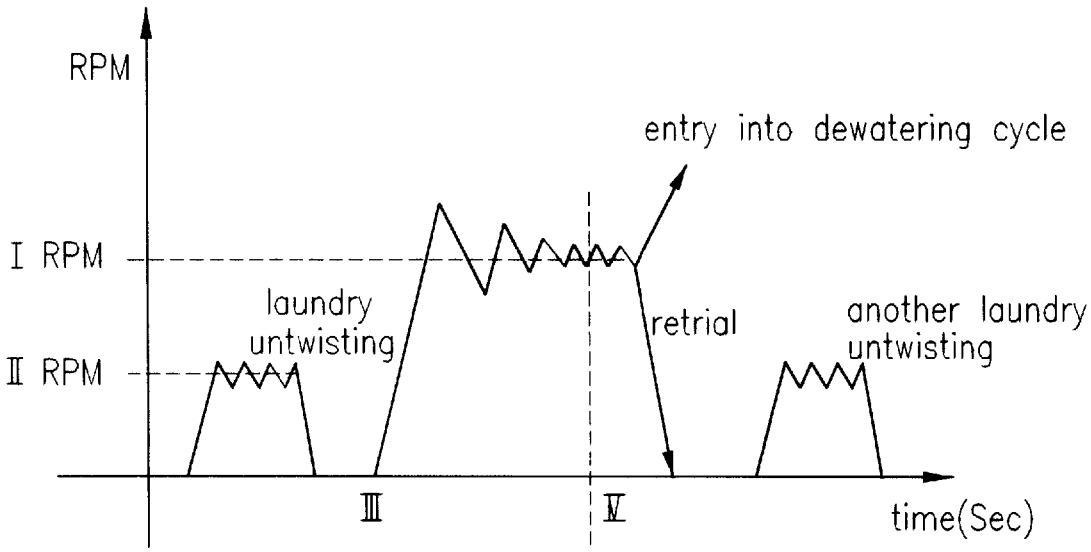
FIG.2 prior art
FIG. 2 is a graphic diagram showing RPM when a conventional drum washing machine enters into hydro-extraction.
Figure 3:
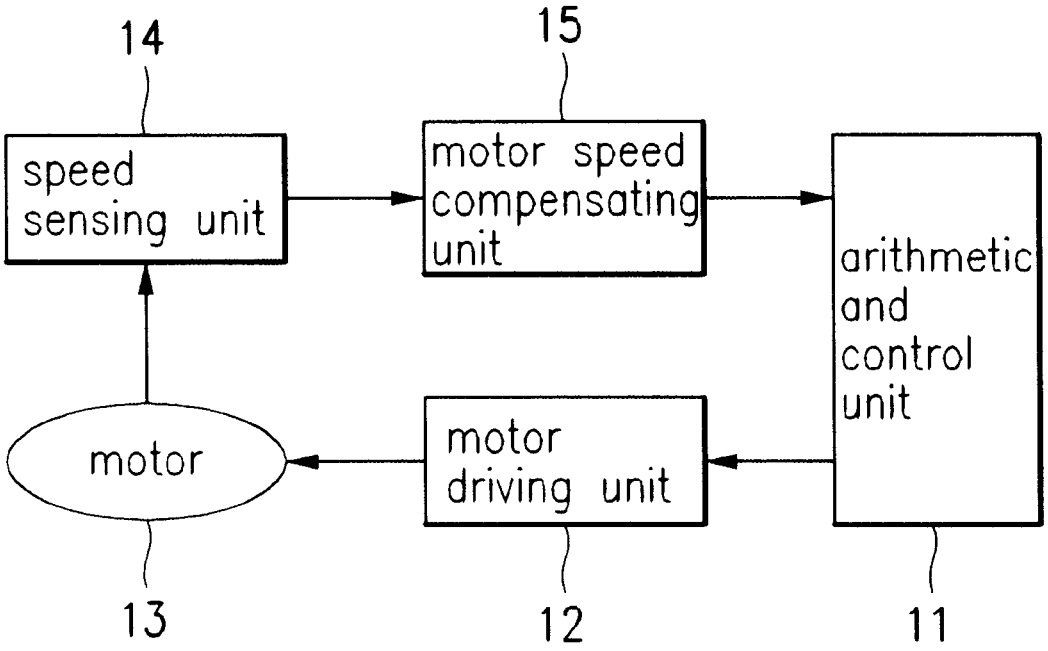
FIG. 3 is a block diagram of a control apparatus of a drum washing machine according to the present invention.

FIG. 3 is a block diagram of a control apparatus of a drum washing machine according to the present invention. Compared with the conventional art depicted in FIG. 1, the control apparatus of a drum washing machine according to the present invention is additionally equipped with a motor speed compensating unit 15 for controlling a tub to rotate at predetermined constant speed.

Specifically, the present invention relates to a drum washing machine for controlling a motor so as to perform cleaning corresponding to each menu which is selected by a user and applied through a key pad (not shown). This drum washing machine having an arithmetic and control unit 11 for controlling the rotation of a motor 13, a motor driving unit 12 for driving the motor 13 according to control of the arithmetic and control unit 11, and a speed sensing unit 14 for sensing the rotational speed of the motor 13 and applying a sensed value to the arithmetic and control unit 11, is additionally equipped with the motor speed compensating unit 15 for detecting a phase angle of driving voltage based upon a difference between motor 13's rotational speed values at the current time point and the previous time point and compensating the detected phase angle so as to control the motor 13 to rotate at constant speed while the arithmetic and control unit 11 controls the motor 13 through the motor driving unit 12 based upon the detected phase angle.

Figure 4:
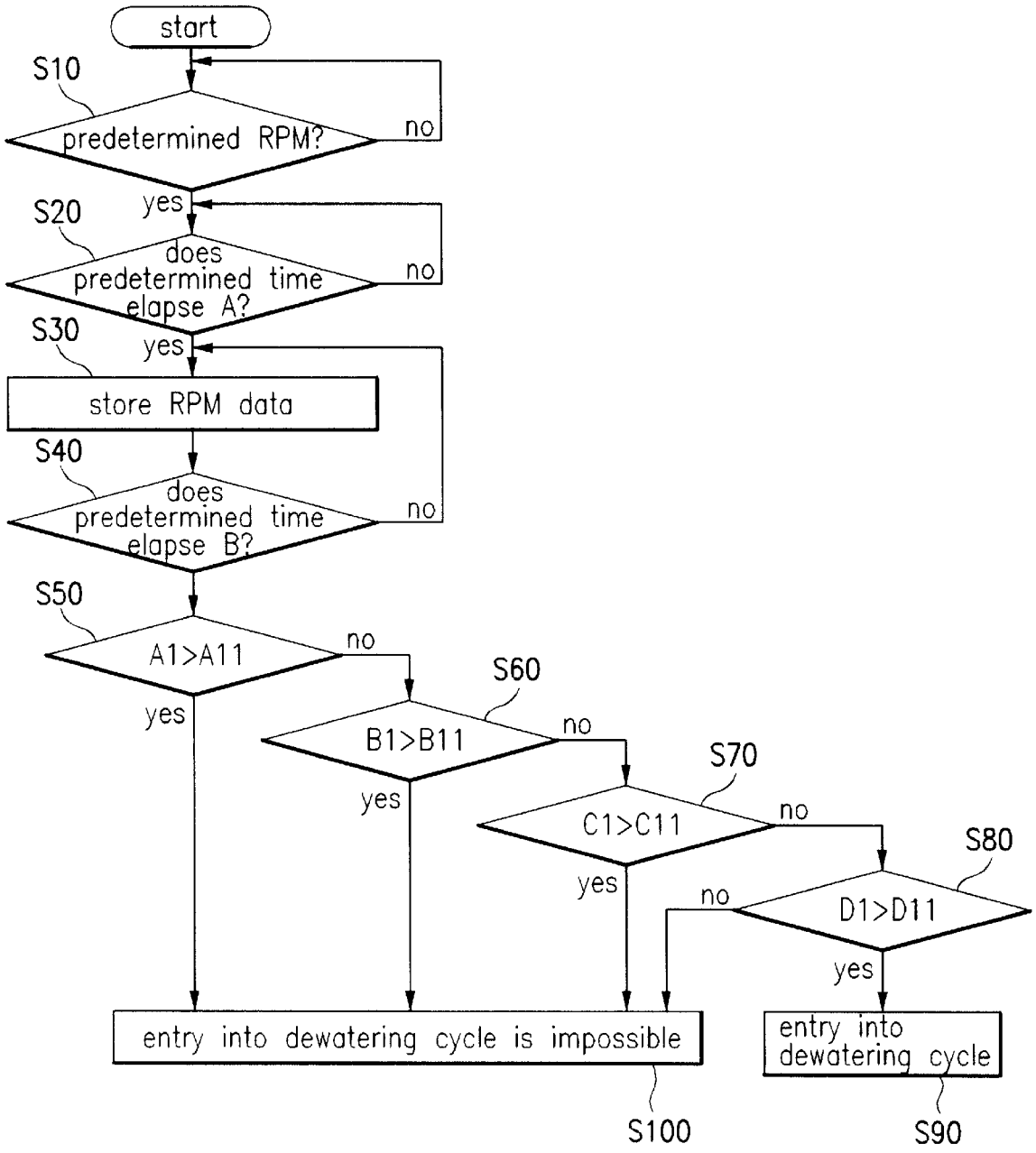
FIG. 4 is a flow chart of an eccentricity detecting method according to a preferred embodiment of the present invention.

FIG. 4 is a flow chart of an eccentricity detecting method according to a preferred embodiment of the present invention. The eccentricity detecting method includes the steps of: detecting the variation of RPM and measuring the degree of eccentricity while positively rotating the tub at constant speed for a predetermined time after laundry untwisting operation is completed (S10–S40); comparing the measured degree of eccentricity with a reference value of eccentricity corresponding to the measured degree of eccentricity among predetermined different reference values of eccentricity and determining whether or not to permit the eccentricity (S50–S80); and newly performing the laundry untwisting operation or performing hydro-extracting operation in a manner of rotating the tub at particular RPM according to a result of decision on the eccentricity illustrated above (S90–S100).

The following description with reference to FIGS. 3 and 4 concerns the hydro-extracting operation of the washing machine according to one preferred embodiment of the present invention.

After completion of the laundry untwisting operation, the arithmetic and control unit 11 controls the motor 13 to positively rotate so as to positively rotate the tub until the tub's rotational speed sensed through the speed sensing unit 14 reaches predetermined RPM (S10).

Once the rotational speed of the tub reaches the predetermined RPM, the arithmetic and control unit 11 controls the tub to rotate at the predetermined speed for a predetermined waiting time and detects the variation of the RPM during the waiting time, thereby to measure the degree of eccentricity (S20–S40).

At this time, there may be various methods, such as a phase proportion and differential (PD) control, for control of the tub, but the drum washing machine of the present invention depicted in FIG. 3 controls the motor driving unit 12 using the arithmetic and control unit 11 to gradually increase the phase angle of the driving voltage applied to the motor 13, thus increasing the rotational speed of the motor 13. When the rotational speed of the motor 13 reaches a predetermined level of RPM, a value of the motor 13's rotational speed sensed by the speed sensing unit 14 is applied to the motor speed compensating unit 15. The motor speed compensating unit 15 measures a difference between phase angles of the driving voltages respectively applied to the rotating motor at a current time point and a previous time point. This difference between the two phase angles measured at the speed compensating unit 15 is applied to the arithmetic and control unit 11, which controls the motor 13 through the motor driving unit 12 so as to maintain the rotational speed of the motor 13 at a predetermined value.

This difference between the two phase angles measured at the motor speed compensating unit 15 corresponds to the variation between the current speed and previous speed of the motor, that is, acceleration. As illustrated, the present invention compensates the phase angle of the driving voltage to be applied to the motor for the acceleration measured at the motor speed compensating unit and applies a result value of compensation to the arithmetic and control unit, thereby to maintain the motor at the predetermined speed.

The method of compensating the phase angle of the driving voltage to be applied to the motor for the acceleration measured at the motor speed compensating unit is as follows.

When the current speed is lower than the previous speed, a value obtained by subtracting a reference speed value from the current speed value is subtracted from the acceleration to compensate for the acceleration in the present invention. A value obtained by subtracting the difference between the two phase angles, that is acceleration from the previous phase angle is applied to the arithmetic and control unit 11 as a phase angle to be newly applied to the motor. In other words, if "current speed<previous speed", the present invention controls the arithmetic and control unit with the following method of compensating for acceleration: "phase angle= previous phase angle−[acceleration−(present speed−reference speed)]×constant".

When the current speed is higher than the previous speed, a value obtained by subtracting a reference speed from the current speed is subtracted from the acceleration to compensate for the acceleration in the present invention. A value obtained by summing up the difference between the two phase angles, that is, acceleration and the previous phase angle is applied to the arithmetic and control unit 11 as a phase angle to be newly applied to the motor. In other words, if "current speed>previous speed", the present invention controls the arithmetic and control unit with the following method of compensating for acceleration: "phase angle= previous phase angle+[acceleration−(present speed−reference speed)]×constant". Here, the constant is a compensatory constant for changing a value of speed into a value of the same unit as that of a phase angle.

Subsequently, the measured degree of eccentricity is compared with a reference value of eccentricity corresponding to the measured degree of eccentricity among the predetermined different reference values of eccentricity, thereby to determine whether or not to permit the eccentricity (S50–S80).

Measuring of the degree of eccentricity of the laundry according to the present invention is implemented by measuring the vibration of RPM occurring in spite of controlling the motor to rotate keeping the predetermined speed using the arithmetic and control unit. Since variation of the rotational speed caused by eccentricity of the laundry is not always constant even though the arithmetic and control unit always controlls the rotational speed of the motor, the rotational speed of the motor must be continuously checked for a predetermined period of time.

Table 1 shows the variation of RPM by subdivided ranges. Reference symbols, A, B, C, and D represent the absolute values of RPM.

TABLE 1

| RPM | A | B | C | D |
|---|---|---|---|---|
| Number of articles | A1 | B1 | C1 | D1 |

For example, if a reference value of the RPM for detecting the degree of eccentricity of the laundry is set to 100, the absolute values may be subdivided as follows: A is 90, B is 100, C is 103, and D is 105. To increase accuracy, A, B, C, and D may be subdivided much more elaborately.

Values of eccentricity corresponding to the number of RPM values measured by the speed sensing unit 14 are registered in the arithmetic and control unit 11 as A1, B1, C1 and D1. The values of eccentricity corresponding to A1, B1, C1, and D1 are compared with a reference value of eccentricity corresponding to the number of RPM values (the measured degree of eccentricity) among the predetermined different levels of reference values of eccentricity (A11, B11, C11, D11), thereby, to determine whether or not to permit the eccentricity. The laundry untwisting operation or hydro-extracting operation where the tub rotates at the particular RPM is performed according to a result of the comparison (S90, S100).

As the result of the comparison, if condition, A1>A11, is satisfied, entry into the dewatering cycle is determined to be impossible. If the condition, A1>A11, is not satisfied, whether or not condition, B1>B11, is satisfied is determined. If the condition, B1>B11, is satisfied, the entry into the dewatering cycle is determined to be impossible, and if the condition, B1>B11, is not satisfied, whether or not condition, C1>C11, is satisfied is determined. If the condition, C1>C11, is satisfied, the entry into the dewatering cycle is determined to be impossible, and if the condition, C1>C11, is not satisfied, whether or not condition, D1>D11, is satisfied is determined. If the condition, D1>D11, is not satisfied, the entry into the dewatering cycle is determined to be impossible, and if the condition, D1>D11, is satisfied, finally, the entry into the dewatering cycle is determined to be possible.

Figure 5:
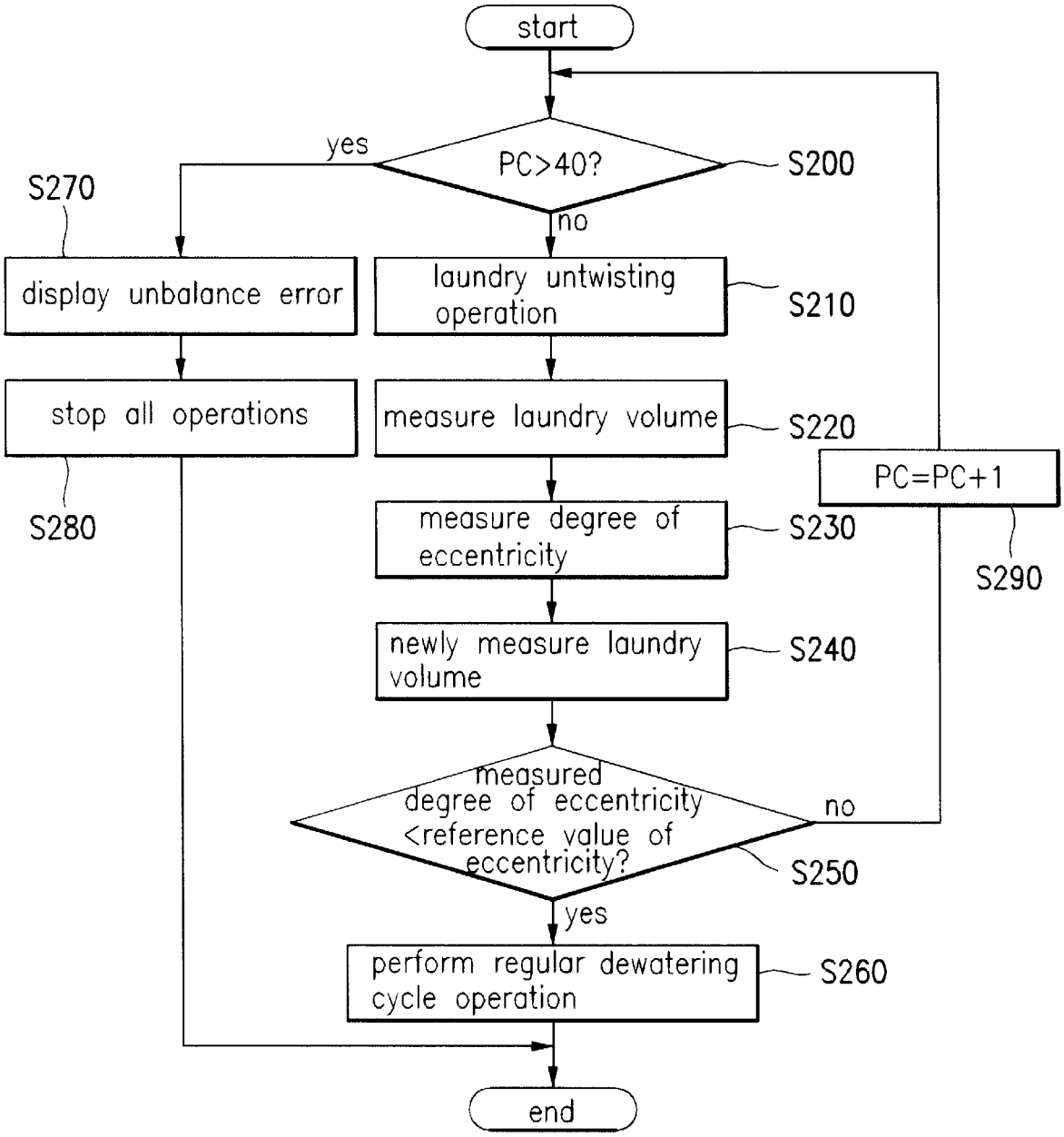
FIG. 5 is a flow chart of an eccentricity detecting method according to another preferred embodiment of the present invention.

FIG. 5 shows an algorithm of the hydro-extracting operation in a washing machine according to another preferred embodiment of the present invention. As shown in FIG. 5, the algorithm of the hydro-extracting operation includes: error decision step (S200, S270, S280) of comparing the number of trials for eccentricity decision with the predetermined reference number of times and determining the entry into the hydro-extracting operation or unbalance error; laundry untwisting step (S210–S220) of performing the laundry untwisting operation by reversely rotating the tub at predetermined rotational speed, if the entry into the hydro-extracting operation is decided, and, simultaneously, measuring the volume of the laundry in the tub with reference to the variation of RPM, thereby to produce a level of the volume of the laundry corresponding to one level of predetermined different levels; eccentricity decision step S230–S250) of measuring degree of eccentricity based upon the variation of the RPM occurring when the tub positively rotates at predetermined rotational speed, measuring the volume of the laundry once more and compensating the level of the volume of the laundry produced through steps S210 and S220 based upon the laundry volume newly measured and the number of trials for eccentricity decision (PC), and comparing the degree of eccentricity measured with a reference value of eccentricity corresponding to the compensated laundry volume level among predetermined reference values of eccentricity of different levels and determining whether or not to permit the eccentricity; and regular dewatering cycle step (S260, S290) of newly perfoming the error decision step (S200, S270, S280) or performing dewatering cycle in a manner of rotating the tub at particular RPM according to a result of performance of the eccentricity decision step (S360–S290).

The following description referring to FIGS. 3 and 5 concerns operation and effect thereof in the second preferred embodiment according to the present invention.

Once the dewatering cycle is commenced, the driving circuit of the washing machine of the present invention attempts to perform the dewatering operation. The number of trials For dewatering(PC) is counted and a counted value is stored in the arithmetic and control unit 11.

The arithmetic and control unit 11 then compares a predetermined reference number of times (for example, 40 times) with the number of the trials (PC). If the entry into the hydro-extracting operation is attempted more than the reference number of times, the arithmetic and control unit judges the status of the laundry to be in unbalance, displays the unbalance error status through a display unit (not shown), and controls Peripheral devices to stop all the operation of the washing machine (S200, S270, S280).

If the number of trials for dewatering(PC) is less than the reference number of times, the arithmetic and control unit 11 controls the motor driving unit so as to reversely rotate the motor at predetermined RPM (for example, 50 RPM). Consequently, the laundry untwisting operation through which the twisted laundry is untwisted by way of reversely rotating the tub is performed (S200–S210).

When the tub is controlled to rotate at predetermined speed during the laundry untwisting operation, the arithmetic and control unit checks variation of RPM for a predetermined period of time and measures volume of the laundry in the tub. The arithmetic and control unit also produces a level corresponding to the volume of the laundry in the tub currently rotating from predetermined laundry volume levels (S220).

After producing the laundry volume level corresponding to the volume of the laundry in the tub through the process illustrated above, the arithmetic and control unit 11 controls the motor 13 to positively rotate at predetermined RPM (for example, 100 RPM) using a phase angle of driving voltage which is compensated by the motor speed compensating unit 15 so as to rotate the tub and measures degree of eccentricity based upon the variation of the RPM sensed by the speed sensing unit 14 (S230).

Subsequently, the arithmetic and control unit 11, after newly measuring the volume of the laundry, compensates the level of the volume of the laundry measured at the beginning based upon the volume of the laundry newly measured and the number of trials for dewatering(PC) and compares the measured degree of eccentricity with a reference value of eccentricty corresponding to a level of the volume of the laundry compensated among predetermined reference values of eccentricity of different levels, thereby to determine whether or not to permit the eccentricity (S240–S250).

The present invention measures the volume of the laundry two times and divides the reference values of eccentricity for deciding eccentricity based upon the measured volume of the laundry into multiple levels. Therefore, compared with the conventional art which detects eccentricity using only one reference amount of eccentricity, the present invention using multiple reference value levels of eccentricity improves reliability in detecting the eccentricity.

Thereafter, the arithmetic and control unit 11 increases the number of trials for eccentricity decision (PC) by 1 according to a result of comparing the reference value of the eccentricity with the measured degree of the eccentricity and newly compares the increased number of trials for eccentricity decision (PC) with the predetermined reference number of times (for example, 40 times) (S290). In addition, as the result of determination on the permission of the eccentricity, the eccentricity is permitted, the tub is rotated at predetermined RPM, thereby to perform the regular hydro-extracting operation (S260).

Figure 6:
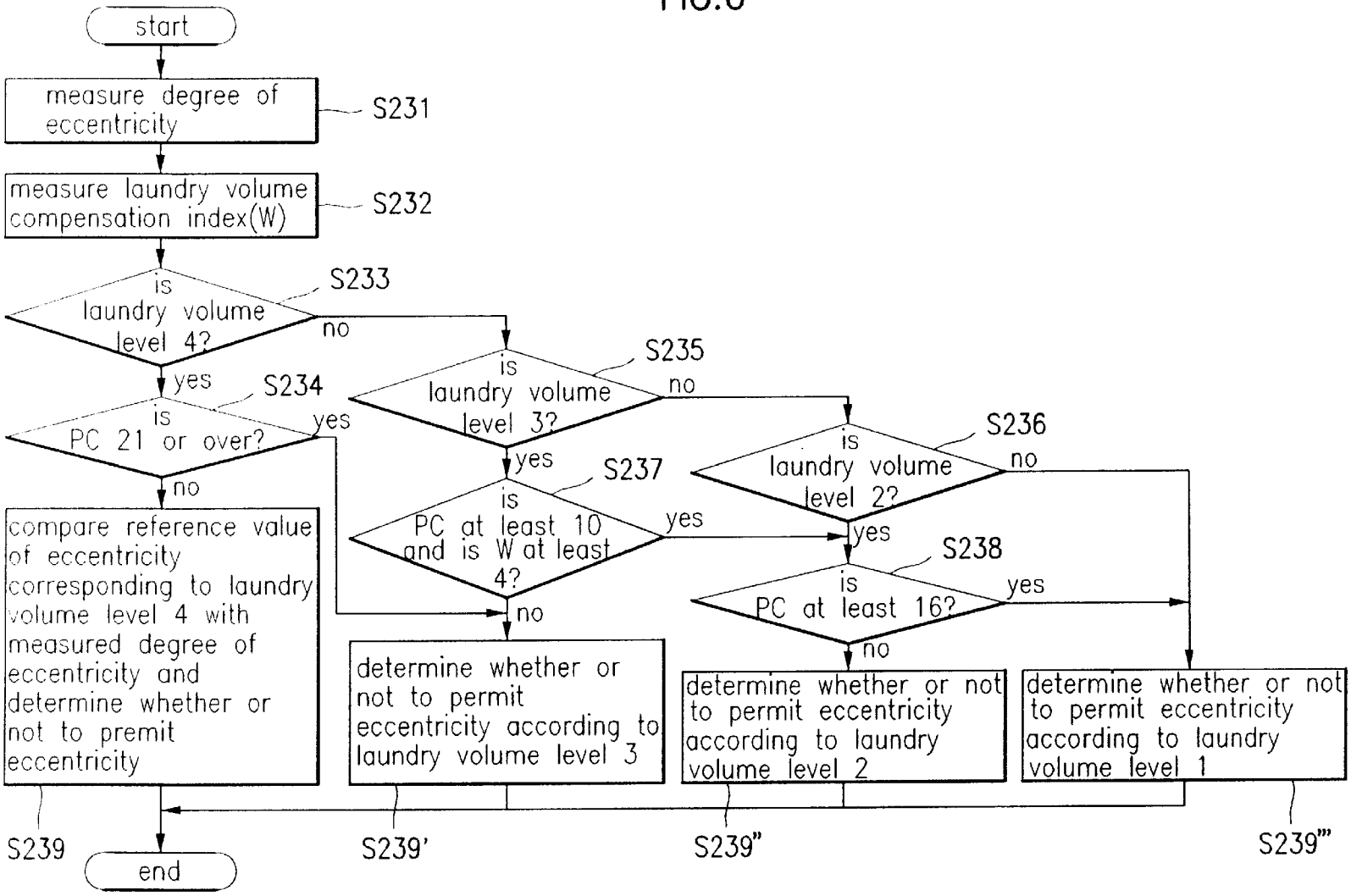
FIGS. 6 and 7 are flow charts illustrating the eccentricity detecting method depicted in FIG. 5 in detail.

FIG. 6 is a flow chart of the eccentricity defecting method illustrating much more in detail the eccentricity decision step (S230–S250). As shown in FIG. 6, the eccentricity detecting method includes: degree of eccentricity measuring step (S231) of controlling the tub to positively rotate at predetermined speed after completion of the laundry untwisting operation and measuring degree of eccentricity based upon variation of RPM occurring when the tub rotates; laundry volume compensation index measuring step (S232) of measuring a laundry volume compensation index used for compensating the produced level of the volume of the laundry by counting the case where the degree of eccentricity measured-at step S231 exceeds a specified value while the number of trials for eccentricity decision (PC) is less than the predetermined number of times; laundry volume level compensating step (S233–S238) of compensating the produced level of the volume of laundry according to the number of trials for eccentricity decision (PC) and the laundry volume compensation index and producing a compensated laundry volume level; and eccentricity permission decision step (S239, S239', S239", S239'") of comparing the measured degree of eccentricty with a reference value of eccentricity corresponding to the compensated laundry volume level among predetermined reference values of eccentricity of different levels, thereby to determine whether or not to permit the eccentricity.

With reference to FIGS. 4 to 6, the eccentricity detecting method of the present invention will now be described.

Once the laundry untwisting procedure and the laundry volume measuring procedure (S210–S220) is completed, the motor 13 is controlled with a phase angle of driving voltage compensated at the motor speed compensating unit 15 so as to rotate the tub at predetermined speed. At this time, the arithmetic and control unit 11 senses variation of motor's rotational speed, that is, variation of RPM through the speed sensing unit 14 and measures degree of eccentricity based upon the variation of the RPM (S231).

The eccentricity detecting method of the present invention measures a laundry volume compensation index (W) used for compensating the produced level of the volume of the laundry by counting the case where the degree of eccentricity measured using the speed sensing unit 14 exceeds a specified value while the number of trials for eccentricity decision (PC) counted at the error decision step (S200) is less than the predetermined number of times (S232).

For example, if the motor is controlled to rotate at he predetermined speed of 100 RPM, the rotational speed of the tub may irregularly change according to the eccentricity of the tub. Hence, the eccentricity detecting method of the present invention counts the laundry volume compensation indexes (w) if the rotational speed reaches 107 RPM more than 70 times for a predetermined period of time when the number of trial for eccentricity decision (PC) is 4 to 10.

The arithmetic and control unit 11 produces a more accurate level of the volume of the laundry by compensating the volume level of the laundry produced at laundry untwisting step (S220) based upon the number of trials for eccentricity decision (PC) and the counted laundry volume compensation indexes (w). In other words, when the level of the volume of the laundry initially produced is 4, if the number of trials for eccentricity decision (PC) is more than a predetermined number for times example: 20), the level of the volume of the laundry becomes 3 through compensation operation (S233, S234). When the level of the volume of the laundry initially produced is 3, if the number of trials for eccentricity decision (PC) is more than a predetermined number of times (for example: 9) and the laundry volume compensation index (w) is more than a predetermined value (for example, 3), the level of the volume of the laundry becomes 2 through compensation operation (S235, S237). When the level of the volume of the laundry initially produced is 2, if the number of trials for eccentricity decision (PC) is more than a predetermined number of times (for example: 15), the level of the volume of the laundry becomes 1 through compensation operation (S236, S238).

After that, the arithmetic and control unit compares the degree of eccentricity measured through the speed sensing unit 14 with a reference value of eccentricity corresponding to the compensated laundry volume level among reference values of eccenrtricity of different levels predetermined according to the produced compensation level of the volume of the laundry, thereby to determine whether or not to permit the eccentricity (S239, S239', S239", S239'"). In other words, the permission of eccentricity depends on the degree of shaking caused by the eccentricity. It is checked whether the degree of eccentricity currently measured at the speed sensing unit 14 causes excessive shaking when the washing machine performs the regular hydro-extracting operation, with various conditions predetermined at the corresponding volume level of the laundry by comparison.

Figure 7:
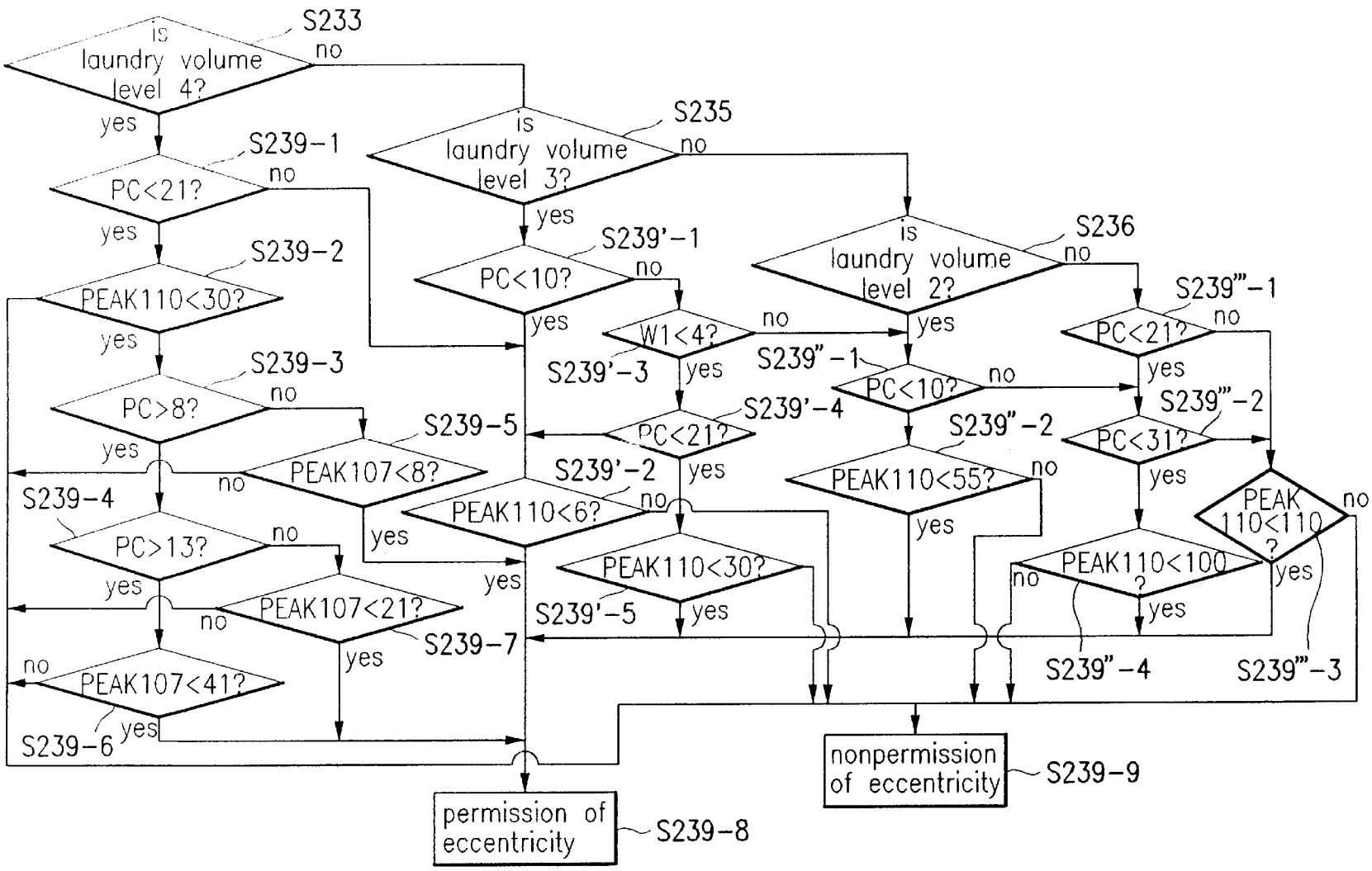

FIG. 7 is a flow chart showing a preferred embodiment of the eccentricity permission decision step (S239, S239', S239", S239'") according to the second embodiment of the present invention, wherein variables, PEAK110 and PEAK107, represent data about degree of eccentricity which is applied to the arithmetic and control unit 11 from the speed sensing unit 14.

When the level of the laundry volume which is finally produced at laundry volume level compensating step (S233–S238) is 4 (S233), if the PEAK110 is 30 or over (S239'-5), the eccentricity is not permitted (S239-9). In addition, when the PC is Less than 8 (S239-3), if the PEAK107 (the number of RPM values between 105 and 107) is less than 8 (S239-5), the eccentricity is permitted, and if the PEAK107 is 8 or over, the eccentricity is not permitted (S239-8).

When the PC is 8 or over or less than 13 (S239-4), if the PEAK107 is less than 21 (S239-7), the eccentricity is permitted, and if the PEAK107 is 21 or over, the eccentricity is not permitted. When the PC is 13 or over (S239-4), if the PEAK107 is less than 41 (S239-6), the eccentricity is permitted, and if the PEAK107 is 41 or over, the eccentricity is not permitted.

When the level of the laundry volume which is finally produced at laundry volume level compensating step (S233–S238) is 3 (S235) and the PC does not exceed 10 (239'-1), if he PEAK110 is less than 6 (S239'-2), the eccentricity is permitted, and if the PEAK110 is 6 or over, the eccentricity is not permitted.

In addition, when the PC is 10 or over and the W is less than 4 (S239'-3), if the PC is 21 or over, step of checking whether the PEAK110 is less than 6 or 6 or over is newly performed. When the PC is less than 21, if the PEAK110 is less than 30 (S239'-5), the eccentricity is permitted, and if the PEAK110 is 30 or over, the eccentricity is not permitted. At this time, when the PC is 10 or over and the W is 4 or over, the laundry volume level becomes 2 through compensation.

When the level of the laundry volume which is finally produced at laundry volume level compensating step (S233–S238) is 2 and the PC is less than 10 (239"-1), if the PEAK110 is less than 55 (S239"-2), the eccentricity is permitted, and if the PEAK110 is 55 or over, the eccentricity is not permitted. At this time, when the PC is 10 or over (239"-1), the laundry volume level becomes 1 through the compensation.

When the level of the laundry volume which is finally produced at laundry volume level compensating step (S233–S238) is 1 and the PC is 21 or over (239'"-1), if the PEAK110 is 110 or over (S239'"-3), the eccentricity is not permitted, and if the PEAK110 is less than 110, the eccentricity is permitted.

When the PC is less than 21, whether the PC is 31 or over is newly checked (239'"-2). If the PC is 31 or over, the step of checking whether the PEAK110 is 110 or over or less than 110 is newly performed. This is for more accurate decision on the permission of the eccentricity when the laundry volume level is modified into 1 from 2 through the compensation. When the PC is less than 31, if the PEAK110 is 100 or over (S239'"-4), the eccentricity is not permitted, and if the PEAK110 is less than 100, the eccentricity is permitted.

As illustrated above, the arithmetic and control unit 11 regulates the twist of the laundry or the degree of eccentricity of the laundry at the eccentricity permission decision step. When it is determined that the degree of the eccentricity is regulated as unbalance error does not occur through the eccentricity permission decision step, the arithmetic and control unit 11 controls the motor 13 to perform regular hydro-extracting operation. However, when the degree of the eccentricity of the laundry is determined not to be regulated satisfactorily, the error decision step (S200, S270, S280) is newly performed and the dewatering cycle is attempted. After all, the entry into the hydro-extracting operation is attempted at least a predetermined reference number of times (for example, 40 times), that is, if the degree of the eccentricity of the laundry is regulated at least the predetermined number of times, occurrence of the unbalance error in the laundry is determined. This unbalance error status is displayed through a display unit (not shown), and peripheral devices are controlled to stop all the operation of the washing machine.

As illustrated above, the present invention detects volume of the laundry in a tub before commencing hydro-extracting operation, divides a process of measuring the degree of eccentricity into multiple steps according to laundry volume levels detected, and compensates the initially detected laundry volume through the multiple steps, thereby to minimize mistakes in detecting the eccentricity due to an error in detection of the laundry volume. Accordingly, the present invention prevents walking phenomenon of a washing machine which may occur due to excessive shaking while performing the hydro-extracting operation.

It will be apparent to those skilled in the art that various modifications and variations can be made in a method and control apparatus of detecting eccentricity in a drum washing machine of the present invention without deviating from the spirit or scope of the invention. Thus, it is intended that the present invention cover the modifications and variations of this invention provided they come within the scope of the appended claims and their equivalents.

What is claimed is:

1. A method of detecting eccentricity in a washing machine, the method comprising the steps of:

detecting a variation of a rotational speed of a tub of the washing machine while rotating the tub substantially at a predetermined speed;

measuring a degree of eccentricity based on the detected rotational speed variation; and deciding whether to permit the measured eccentricity by comparing the measured degree of eccentricity with one of a plurality of predetermined eccentricity reference values.

2. The method according to claim 1, wherein during the detecting step, the variation of motor's rotational speed is subdivided into multiple predetermined levels, and wherein during the deciding step the reference value of eccentricity that is compared to the measured degree of eccentricity is selected according to the subdivided levels.

3. The method according to claim 1, wherein the deciding step comprises comparing the measured degree of eccentricity to all of the predetermined reference values of eccentricity.

4. The method according to claim 1, wherein the detecting step comprises the sub-steps of:

if a current speed of a tub-driving motor of the washing machine is lower than a previous speed after a rotational speed of the tub reaches a predetermined value, setting a phase angle of a driving voltage to be applied to the motor through the following formula:

"phase angle=previous phase angle−(acceleration−(current speed−reference speed))×constant";

and if the current speed of the motor is higher than a previous speed after the rotational speed of the tub reaches a predetermined value, setting a phase angle of a driving voltage to be applied to the motor through the following formula:

"phase angle=previous phase angle+(acceleration−(current speed−reference speed))×constant".

5. A method of detecting eccentricity in a washing machine, the method comprising the steps of:

detecting a degree of eccentricity by controlling a tub of the washing machine such that it rotates substantially at a predetermined speed, and detecting a variation of the rotational speed of the tub;

determining a laundry volume compensation index by counting the number of times the detected degree of eccentricity exceeds a specified value, and setting the counted value as the laundry volume compensation index;

determining a compensated laundry volume level based on a previously produced laundry volume level, a number of trials for an eccentricity decision, and the determined laundry volume compensation index; and determining whether to permit the detected degree of eccentricity by comparing the detected degree of eccentricity with one of a plurality of reference values of eccentricity that corresponds to the determined compensated laundry volume level.

6. The method according to claim 5, wherein the step of determining a compensated laundry volume level comprises comparing the number of trials for an eccentricity decision with multiple predetermined reference numbers of times to calculate a trial difference number and comparing the determined laundry volume compensation index with multiple predetermined reference values to calculate an index difference value, and wherein the compensated laundry volume level is based on the trial difference number and the index difference value.

7. The method according to claim 5, wherein the step of determining whether to permit the detected degree of eccentricity comprises comparing the detected degree of eccentricity with one of a plurality of predetermined reference values of eccentricity that are established according to the number of trials for an eccentricity decision.

8. The method according to claim 5, wherein the step of detecting a degree of eccentricity comprises the sub-steps of:

if a current speed of a tub-driving motor is lower than a previous speed after a rotational speed of the tub reaches a predetermined value, setting a phase angle of a driving voltage to be applied to the tub driving motor through the following formula:

"phase angle=previous phase angle−(acceleration−(current speed−reference speed))×constant";

and if a current speed of the tub driving motor is higher than a previous speed after the rotational speed of the tub reaches a predetermined value, setting a phase angle of a driving voltage to be applied to the tub driving motor through the following formula, "phase angle=previous phase angle+(acceleration−(current speed−reference speed))×constant".

9. A driving system of a drum washing machine comprising:

an arithmetic and control unit that produces a driving signal for controlling a tub driving motor;

a motor driving unit for driving the tub driving motor based on the driving signal produced by the arithmetic and control unit;

a speed sensing unit for sensing a rotational speed of the tub driving motor and for applying a rotational speed value to the arithmetic and control unit; and a motor speed compensating unit for receiving the rotational speed value from the speed sensing unit, wherein the motor speed compensating unit detects a difference between a phase angle of a driving voltage applied to the tub driving motor at a first point in time with a phase angle of a driving voltage applied to the tub driving motor at a second point in time, and wherein the compensating unit produces a difference signal that is applied to the arithmetic and control unit.

10. The driving system of claim 9, wherein the arithmetic and control unit produces a driving signal that keeps the rotational speed of the tub driving motor substantially constant based on the difference signal produced by the motor speed compensating unit.

11. The driving system of claim 9, wherein the arithmetic and control unit is configured to determine a degree of eccentricity of a tub of the washing machine, and to determine whether the degree of eccentricity is acceptable.

12. The driving system of claim 11, wherein the arithmetic and control unit is further configured to halt a washing machine cycle if the degree of eccentricity is determined to not be acceptable.

13. The driving system of claim 11, wherein the arithmetic and control unit determines a degree of eccentricity of a tub based on a number of times that a rotational speed of the tub changes during a predetermined period of time.

14. The driving system of claim 11, wherein the arithmetic and control unit determines whether the degree of eccentricity is acceptable by comparing the determined degree of eccentricity to a selected eccentricity reference value.

15. The driving system of claim 14, wherein selected eccentricity reference value is selected based on a compensated laundry volume level.

16. The driving system of claim 15, wherein the compensated laundry volume level is based on a detected laundry volume level, and a laundry volume compensation index value.

17. The driving system of claim 16, wherein the laundry volume compensation index value is based on a number of times that the determined degree of eccentricity exceeds a predetermined value during a predetermined period of time.

18. The driving system of claim 16, wherein the compensated laundry volume level is also based on a number of times that the arithmetic and control unit has attempted to determine whether a detected degree of eccentricity is acceptable.

19. A driving system of a washing machine, comprising:

a tub driving motor;

a speed sensor configured to determine a rotational speed of the motor; and a controller configured to drive the motor at a substantially constant speed, to determine a degree of eccentricity of a tub driven by the motor, and to determine whether the determined degree of eccentricity is acceptable, wherein the controller compares a phase angle of a motor driving signal at a first point in time to a phase angle of a motor driving signal at a second point in time to derive a phase angle difference, and wherein the controller alters a phase angle of the motor driving signal based on the phase angle difference to drive the motor at a substantially constant speed.

20. The driving system of claim 19, wherein the controller determines whether the determined degree of eccentricity is acceptable by comparing the determined degree of eccentricity to a selected eccentricity reference value, and wherein the eccentricity reference value is selected based on a number of times that the determined eccentricity value exceeds a predetermined value.

* * * * *